US011450971B2

(12) United States Patent
Kucera et al.

(10) Patent No.: US 11,450,971 B2
(45) Date of Patent: Sep. 20, 2022

(54) APPARATUS COMPRISING A PLURALITY OF ANTENNA DEVICES AND METHOD OF OPERATING SUCH APPARATUS

(71) Applicant: Nokia Solutions and Networks Oy, Espoo (FI)

(72) Inventors: Stepan Kucera, Dublin (IE); Dmitry Kozlov, Dublin (IE)

(73) Assignee: Nokia Solutions and Networks Oy, Espoo (FI)

( * ) Notice: Subject to any disclaimer, the term of this patent is extended or adjusted under 35 U.S.C. 154(b) by 0 days.

(21) Appl. No.: 16/874,940

(22) Filed: May 15, 2020

(65) Prior Publication Data

US 2020/0373679 A1 Nov. 26, 2020

(30) Foreign Application Priority Data

May 23, 2019 (EP) ..... 19176122

(51) Int. Cl.
*H01Q 21/06* (2006.01)
*H01Q 21/00* (2006.01)
*H01Q 5/371* (2015.01)

(52) U.S. Cl.
CPC ..... *H01Q 21/0037* (2013.01); *H01Q 5/371* (2015.01); *H01Q 21/065* (2013.01)

(58) Field of Classification Search
CPC combination set(s) only.
See application file for complete search history.

(56) References Cited

U.S. PATENT DOCUMENTS 6,421,021 B1 7/2002 Rupp et al.
2007/0230639 A1* 10/2007 Stirling-Gallacher ..... H04B 7/0408 375/347
2010/0072829 A1 3/2010 Mason et al.
2010/0231325 A1 9/2010 Hauhe et al.
(Continued)

FOREIGN PATENT DOCUMENTS

WO 2018/119153 A2 6/2018

OTHER PUBLICATIONS

Almasi et al., "A New Reconfigurable Antenna MIMO Architecture for Mmwave Communication", arXiv, Mar. 25, 2018, 7 pages.
(Continued)

*Primary Examiner* — Daniel Munoz
(74) *Attorney, Agent, or Firm* — Mendelsohn Dunleavy, P.C.; Yuri Gruzdkov; Steve Mendelsohn

(57) ABSTRACT

Apparatus comprising a plurality of antenna devices and a feeding device, wherein said feeding device is configured to receive a first input signal, to generate a plurality of first output signals by power dividing said first input signal, and to provide said plurality of first output signals to said plurality of antenna devices, wherein two or more of said antenna devices comprise a first antenna element for receiving at least a portion of said plurality of first output signals as a second input signal, a signal processing device configured to determine a second output signal depending on said second input signal by at least temporarily modifying a phase and/or an amplitude of said second input signal or a signal derived from said second input signal, and a second antenna element, wherein said signal processing device is configured to provide said second output signal to said second antenna element.

18 Claims, 4 Drawing Sheets

(56) References Cited

U.S. PATENT DOCUMENTS

| | | | | |
|---|---|---|---|---|
| 2012/0050107 | A1* | 3/2012 | Mortazawi | H01Q 21/0006 342/372 |
| 2012/0052812 | A1* | 3/2012 | Frei | H04W 16/14 455/63.1 |
| 2016/0248157 | A1 | 8/2016 | Rao et al. | |
| 2018/0062266 | A1 | 3/2018 | Haziza | |
| 2020/0259271 | A1* | 8/2020 | Lin | H01Q 25/02 |

OTHER PUBLICATIONS

Almasi et al., "Reconfigurable Antennas in Mmwave MIMO Systems", arXiv, Oct. 24, 2017, pp. 1-12.

Shen et al., "Channel Feedback Codebook Design for Millimeter-wave Massive MIMO Systems Relying on Lens Antenna Array", IEEE Wireless Communications Letters, vol. 7, No. 5, Oct. 2018, pp. 736-739.

Lien et al., "Optimum Ultra-reliable and Low Latency Communications in 5G New Radio", Mobile Networks and Applications, vol. 23, 2018, 8 pages.

Extended European Search Report received for corresponding European Patent Application No. 19176122.0, dated Nov. 27, 2019, 9 pages.

* cited by examiner

APPARATUS COMPRISING A PLURALITY OF ANTENNA DEVICES AND METHOD OF OPERATING SUCH APPARATUS

CROSS-REFERENCE TO RELATED APPLICATION

This application claims the benefit of European patent application No. 19176122.0 filed on May 23, 2019, titled "APPARATUS COMPRISING A PLURALITY OF ANTENNA DEVICES AND METHOD OF OPERATING SUCH APPARATUS", the content of which is incorporated herein by reference in its entirety.

FIELD OF THE INVENTION

Exemplary embodiments relate to an apparatus comprising a plurality of antenna devices and a feeding device.

Further exemplary embodiments relate to a method of operating such apparatus.

BACKGROUND

In current millimeter (mm)-wave networks, i.e. networks transmitting signals using electromagnetic waves in the millimeter range, transceivers transmit/receive a wireless data signal by using a high-gain antenna array.

SUMMARY

Exemplary embodiments relate to an apparatus comprising a plurality of antenna devices and a feeding device, wherein said feeding device is configured to receive a first input signal, to generate a plurality of first output signals by power dividing said first input signal, and to provide said plurality of first output signals to said plurality of antenna devices, wherein two or more of said antenna devices comprise a first antenna element for receiving at least a portion of said plurality of first output signals as a second input signal, a signal processing device configured to determine a second output signal depending on said second input signal by at least temporarily modifying a phase and/or an amplitude of said second input signal or a signal derived from said second input signal, and a second antenna element, wherein said signal processing device is configured to provide said second output signal to said second antenna element. This enables to deliver a signal to be transmitted in multiple replicas or copies, wherein according to further exemplary embodiments said multiple replicas or copies may comprise a same or at least a substantially same signal power. Moreover, the plurality of antenna devices, which may be considered as a "multi-beam antenna element or system", enable multi-path radiation of said signal replicas or copies, respectively. In other words, exemplary embodiments enable to transmit said first input signal or a signal derived therefrom in the form of multiple beams of electromagnetic radiation thus enabling an efficient multi-path concept which increases transmission reliability. According to further exemplary embodiments, a similar multi-path concept may (optionally) be used at a receiver, where multiple beams can be used to receive individual replicas or copies with e.g. stand-alone reception beams to improve a reception quality. According to further exemplary embodiments, such receiver may also be implemented using the plurality of antenna devices of the abovementioned structure, wherein transmit and receive directions are correspondingly changed. However, according to further embodiments, a single beam can also be used on a receiver side to receive the transmitted signal(s) as well.

The apparatus according to exemplary embodiments enables to provide a multi-beam capable transmission and/or reception system at comparatively low complexity and/or costs (as compared with prior art) without compromising on radiation performance. The plurality of antenna devices may also be considered as a "reconfigurable lens" for electromagnetic radiation with multiple feeding elements, wherein the aspect of reconfigurability is e.g. provided by the individual signal processing devices of the antenna devices, and wherein the multiple feeding elements may e.g. be enabled by the power dividing capability of the feeding device.

According to further exemplary embodiments, the first antenna element and/or the second antenna element of said at least one of said antenna devices is a planar antenna element, preferably a patch antenna element, which enables a small design and cost-effective production. According to further exemplary embodiments, the first antenna element and/or the second antenna element of said at least one of said antenna devices may also comprise other type(s) of antenna elements, i.e. horn antennas or the like.

According to further exemplary embodiments, two or more, preferably all, of said antenna devices comprise a printed circuit board, wherein the first antenna element and/or the second antenna element are arranged on a respective surface of the printed circuit board. This further enables cost-effective production of the antenna devices utilizing existing manufacturing processes.

According to further exemplary embodiments, all of said antenna devices are arranged on a common printed circuit board.

According to further exemplary embodiments, 4 or more antenna devices are provided, preferably 16 or more antenna devices, wherein said antenna devices are preferably arranged in a matrix-type pattern comprising a first number of rows and a second number of columns. As an example, according to further embodiments, an antenna pattern with 100 antenna devices arranged in one virtual plane (e.g. defined by a surface of a printed circuit board) may be provided in form of 10 rows and 10 columns of said antenna devices. According to further exemplary embodiments, non-quadratic arrangements such as e.g. rectangular and/or circular and/or elliptical and/or other forms of arrangement of said plurality of antenna devices are also possible.

According to further exemplary embodiments, the feeding device is configured to equally divide the first input signal into n many first output signals, wherein each of said n many first output signals comprises a 1/n-th part of the signal energy of the first input signal. According to further exemplary embodiments, said step of power dividing may also comprise dividing said first input signal based on at least one metric such as e.g. a signal-to-noise ratio (SNR) and/or a signal-to-interference-plus-noise ratio (SINR) and/or a path loss.

According to further exemplary embodiments, the feeding device comprises a) at least one variable gain amplifier, which enables to control a distribution of signal power to the various replicas or copies of the first input signal.

According to further exemplary embodiments, the feeding device comprises b) at least one patch antenna or horn antenna for providing said plurality of first output signals or signals derived from said plurality of first output signals to said plurality of antenna devices.

According to further exemplary embodiments, said apparatus is also configured to receive, via said plurality of antenna devices, electromagnetic waves, i.e. in addition to its capability to transmit electromagnetic waves in the form of multiple beams depending on said first input signal.

According to further exemplary embodiments, said apparatus is configured to receive and/or transmit electromagnetic waves in the millimeter range. As an example, the apparatus may be configured to transmit and/or receive and/or process electromagnetic waves and corresponding electric signals at e.g. 28 GHz. According to further exemplary embodiments, said apparatus is configured to receive and/or transmit electromagnetic waves in frequency ranges as used e.g. for 5G communications systems.

Further exemplary embodiments relate to a method of operating an apparatus comprising a plurality of antenna devices and a feeding device, wherein said feeding device receives a first input signal, generates a plurality of first output signals by power dividing said first input signal, and provides said plurality of first output signals to said plurality of antenna devices, wherein two or more of said antenna devices comprise a first antenna element for receiving at least a portion of said plurality of first output signals as a second input signal, a signal processing device configured to determine a second output signal depending on said second input signal by at least temporarily modifying a phase and/or an amplitude of said second input signal or a signal derived from said second input signal, and a second antenna element, wherein said signal processing device provides said second output signal to said second antenna element.

According to further exemplary embodiments, said method further comprises deploying one or more scattering objects, particularly objects having a metallic or metallized surface, in a transmission area surrounding the apparatus according to the embodiments and/or its antenna devices. This enables to increase signal transmission quality by also exploiting potential non-line-of-sight (NLOS-) paths.

According to further exemplary embodiments, said method further comprises generating at least two beams by means of said plurality of antenna devices for transmitting information comprised within said first input signal via said at least two beams.

According to further exemplary embodiments, said method further comprises at least one of the following elements: a) determining, preferably periodically, a quality measure associated with at least one transmit-receive-beam pair, e.g. a signal-to-noise ratio (SNR) associated with said at least one transmit-receive-beam pair, b) identifying N many transmit-receive beam pairs and dividing a signal power of said first input signal to said N many transmit-receive beam pairs, particularly such that one or more predetermined criteria for a signal transmission using said apparatus can be met. According to further exemplary embodiments, such predetermined criteria may comprise: a target data rate (e.g., to be able to deliver all data to be transmitted in a single transport block), one or more beams satisfying a (e.g. PHY (physical layer-related)) reliability constraint (e.g., expressed as a minimal sector width or maximal number of beam pairs supporting a target data rate).

According to further exemplary embodiments, said method further comprises applying a rate adaptation algorithm and/or a latency control algorithm, particularly with respect to one or more predetermined reliability goals.

Further exemplary embodiments relate to a computer program comprising instructions which, when the program is executed by a computer, cause the computer to carry out the method according to the embodiments.

Further exemplary embodiments relate to a computer-readable storage medium comprising instructions which, when executed by a computer, cause the computer to carry out the method according to the embodiments.

Further exemplary embodiments relate to a control unit configured to perform the method according to the embodiments and/or to control the apparatus according to the embodiments.

BRIEF DESCRIPTION OF THE FIGURES

Some exemplary embodiments will now be described with reference to the accompanying drawings.

DESCRIPTION OF THE EMBODIMENTS

Figure 1:
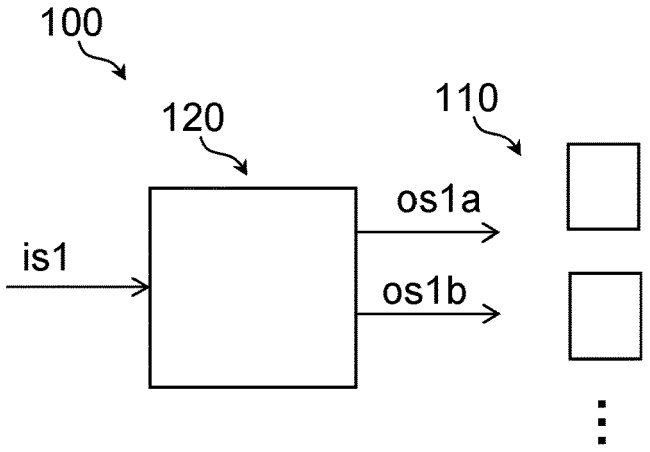
FIG. 1 schematically depicts a simplified block diagram of an apparatus according to exemplary embodiments, FIG. 2 schematically depicts a simplified block diagram of an antenna device according to exemplary embodiments, FIG. 3A schematically depicts a perspective view of an antenna device according to further exemplary embodiments, FIG. 3B schematically depicts a side view of an antenna device according to further exemplary embodiments, FIG. 4 schematically depicts a top view of an antenna arrangement according to further exemplary embodiments, FIG. 5 schematically depicts a perspective view of a feeding device according to further exemplary embodiments, FIG. 6 schematically depicts a simplified block diagram of an apparatus according to further exemplary embodiments, FIG. 7 schematically depicts a simplified block diagram of a system according to further exemplary embodiments, FIG. 8 schematically depicts a simplified flow-chart of a method according to further exemplary embodiments, FIG. 9 schematically depicts a simplified flow-chart of a method according to further exemplary embodiments, and FIG. 10 schematically depicts a simplified block diagram of a control unit according to further exemplary embodiments.

FIG. 1 schematically depicts a simplified block diagram of an apparatus 100 according to exemplary embodiments. The apparatus 100 comprises a plurality of antenna devices 110 and a feeding device 120, wherein said feeding device 120 is configured to receive a first input signal is1 (e.g., a signal in the mm wave range to be transmitted via said apparatus 100), to generate a plurality of first output signals os1*a*, os1*b* by power dividing said first input signal is1, and to provide said plurality of first output signals os1*a*, os1*b* to said plurality of antenna devices 110.

Figure 2:
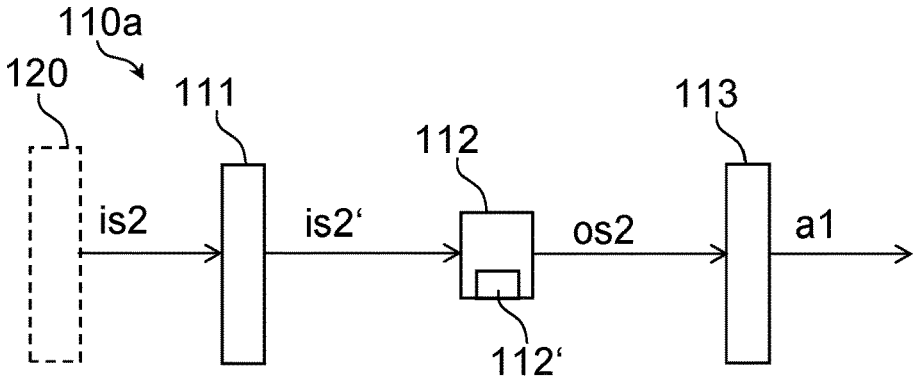

According to further exemplary embodiments, two or more of said antenna devices 110 comprise a structure as exemplarily depicted by FIG. 2 for an antenna device 110*a*. In other words, two or more of the antenna devices 110 of the apparatus 100 of FIG. 1 may comprise the configuration 110*a* of FIG. 2. The antenna device 110*a* comprises a first antenna element 111 for receiving at least a portion of said plurality of first output signals os1*a*, os1*b* (FIG. 1) as a second input signal is2, a signal processing device 112 (e.g., in form of an integrated circuit (IC)) configured to determine a second output signal os2 depending on said second input signal is2 by at least temporarily modifying a phase and/or an amplitude of said second input signal is2 or a signal is2' derived from said second input signal is2 (e.g., signal is2' represents an electric signal as obtained by the first antenna element 111 upon receipt of the second input signal is2), and a second antenna element 113. Said signal processing device 112 is configured to provide said second output signal os2 to said second antenna element 113, for radiation e.g. to a receiver (not shown). Arrow a1 indicates the irradiated signal.

The above-explained configuration of the apparatus 100 enables to deliver a signal is1 to be transmitted in multiple replicas or copies, wherein according to further exemplary embodiments said multiple replicas or copies may comprise a same or at least a substantially same signal power. Moreover, the plurality of antenna devices 110 (FIG. 1), which may be considered as a "multi-beam antenna element or system", enable multi-path radiation of said signal replicas or copies, respectively. In other words, exemplary embodiments enable to transmit said first input signal is1 or a signal os2 derived therefrom in the form of multiple beams of electromagnetic radiation thus enabling an efficient multi-path concept which increases transmission reliability.

According to further exemplary embodiments, the signal processing device 112 of each of said plurality of antenna devices 110 may be individually controlled to at least temporarily modify a phase and/or an amplitude of said second input signal is2 (FIG. 2) to the respective antenna device 110*a*, whereby flexible beam generation is enabled.

According to further exemplary embodiments, it is also possible to at least temporarily control the signal processing devices 112 of several antenna devices collectively.

According to further exemplary embodiments, the signal processing device 112 may comprise a control input 112' for receiving a control signal enabling to temporarily modify a phase and/or an amplitude of said second input signal is2.

According to further exemplary embodiments, a similar multi-path concept may (optionally) be used at a receiver, where multiple beams can be used to receive individual replicas or copies with e.g. stand-alone reception beams to improve a reception quality. According to further exemplary embodiments, such receiver may also be implemented using the plurality of antenna devices 110 of the abovementioned structure, wherein transmit and receive directions are correspondingly changed. Also, according to further embodiments, and in analogy to the feeding device 120 for the transmit case, such receiver may comprise a receiver processing device (not shown) for processing received signals as obtained by the multiple antenna devices 110 in a receive direction.

However, according to further embodiments, a single beam can also be used on a receiver side to receive the transmitted RF energy of the apparatus 100 as well.

The apparatus 100 according to exemplary embodiments enables to provide a multi-beam capable transmission and/or reception system at comparatively low complexity and/or costs (as compared with prior art) without compromising on radiation performance. The plurality of antenna devices 110, 110*a* may also collectively be considered as a "reconfigurable lens" for electromagnetic radiation with multiple feeding elements, wherein the aspect of reconfigurability is e.g. provided by the individual signal processing devices 112 of the antenna devices 110, 110*a*, and wherein the multiple feeding elements may e.g. be enabled by the power dividing capability of the feeding device 120 (FIG. 1).

Figure 3A:
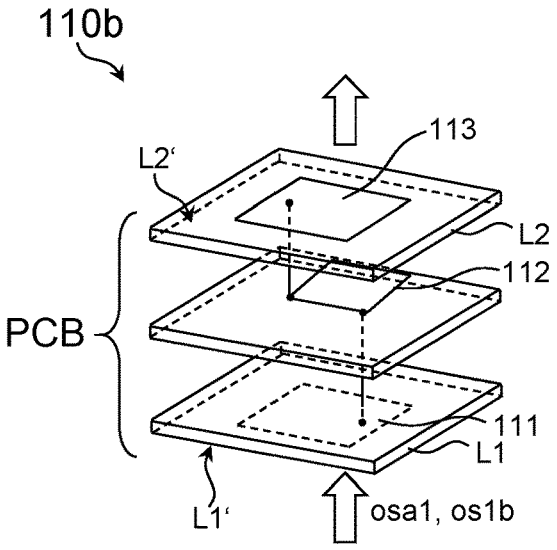

According to further exemplary embodiments, the first antenna element 111 (FIG. 2) and/or the second antenna element 113 of said at least one of said antenna device 110, 110*a* is a planar antenna element, preferably a patch antenna element, which enables a small design and cost-effective production. This is exemplarily depicted by the perspective view of FIG. 3A showing an antenna device 110*b* implemented using a multi-layer printed circuit board PCB. On a first surface L1' of a first PCB layer L1, the first antenna element 111 is provided in the form of a patch antenna, and on a first surface L2' of a second PCB layer L2, the second antenna element 113 is provided in the form of a patch antenna. The signal processing device 112 is preferably integrated in a third (presently intermediate) PCB layer arranged between said PCB layers L1, L2. Electrical connections between the antennas 111, 113 and the signal processing device 112 may be provided by using vias.

Figure 3B:
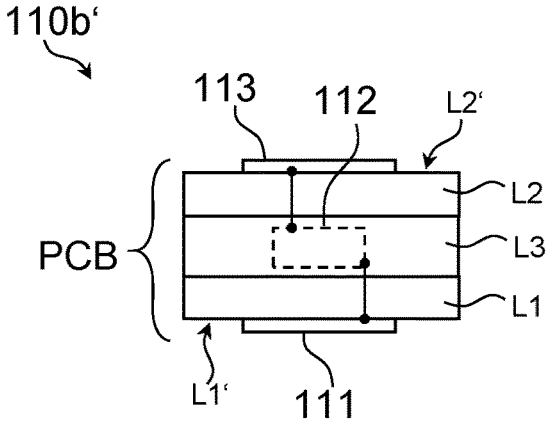

FIG. 3B schematically depicts a side view of an antenna device 110*b*' according to further exemplary embodiments. Similar to the configuration 110*b* of FIG. 3A, the signal processing device 112 is embedded in a third (presently intermediate) PCB layer L3. However, according to further exemplary embodiments, said signal processing device 112 may also be arranged on or within at least one of the PCB layers L1, L2.

According to further exemplary embodiments, two or more, preferably all of said antenna devices 110 (FIG. 1) comprise a printed circuit board, wherein the first antenna element 111 and/or the second antenna element 113 are arranged on a respective surface of the printed circuit board. This further enables cost-effective production of the antenna devices 110 utilizing existing manufacturing processes.

According to further exemplary embodiments, all of said antenna devices are arranged on a common printed circuit board. This is exemplarily depicted by the top view of FIG. 4, according to which an antenna arrangement 1100 of 100 antenna devices is provided on a single, common carrier, i.e. printed circuit board PCB'. The printed circuit board PCB' of FIG. 4 may e.g. be a multilayer PCB, e.g. comprising three layers similar to elements L1, L2, L3 of the configurations 110*b*, 110*b*' of FIGS. 3A and 3B.

According to further exemplary embodiments, 4 or more antenna devices are provided, preferably 16 or more antenna devices, wherein said antenna devices are preferably arranged in a matrix-type pattern comprising a first number of rows and a second number of columns. As an example, as already mentioned above, according to further embodiments, an antenna pattern with 100 antenna devices arranged in one virtual plane (e.g. defined by a surface of a printed circuit board PCB') may be provided in form of 10 rows and 10 columns of said antenna devices, cf. FIG. 4. According to further exemplary embodiments, non-quadratic arrangements (not shown) such as e.g. rectangular and/or circular and/or elliptical and/or other forms of arrangement of said plurality of antenna devices are also possible.

Figure 4:
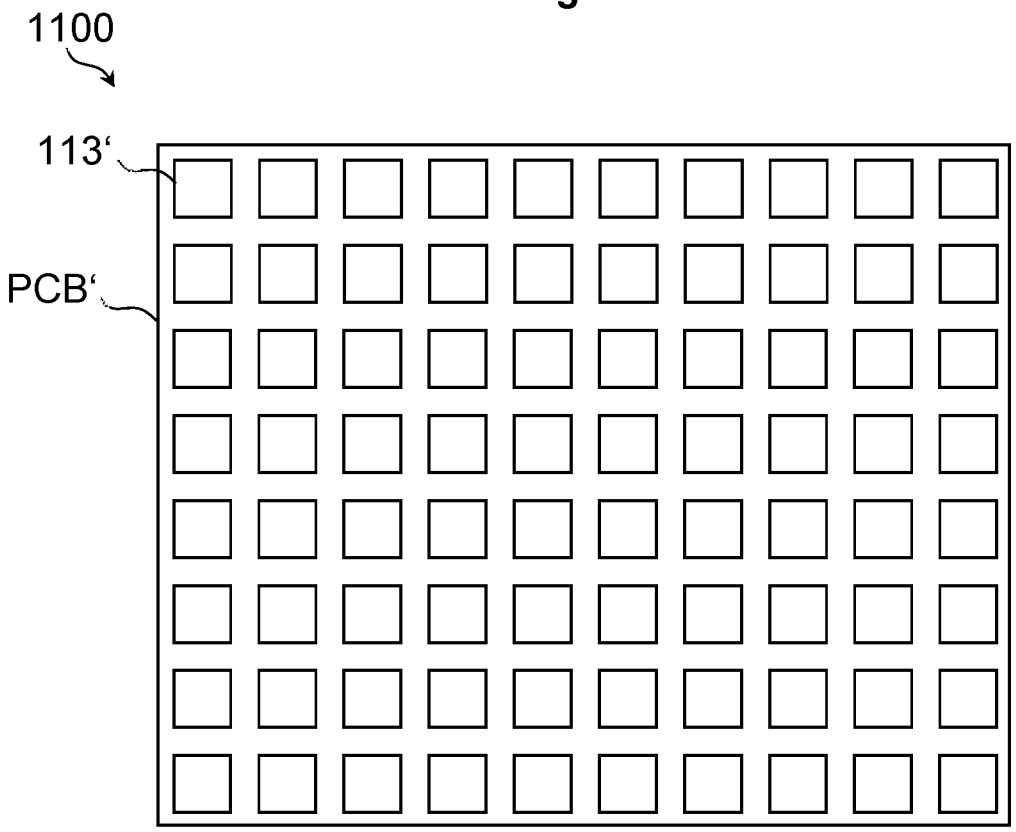

In the exemplary embodiment of FIG. 4, the 100 antenna devices arranged within the common printed circuit board PCB' form a monolithic antenna arrangement 1100 which may also be denoted as a planar "lens", as the antenna arrangement 1100 is implemented using the planar printed circuit board PCB', and as the antenna devices arranged within the common printed circuit board PCB' may be used to influence an electromagnetic field of radiation as provided e.g. in the form of the first output signals os1*a*, os1*b* (FIG. 1) by the feeding device 120.

According to further exemplary embodiments, influencing an electromagnetic field of radiation may e.g. comprise: a) receiving the first output signals os1*a*, os1*b* provided by the feeding device 120 (said receiving e.g. being performed using the respective first antenna elements 111 (FIG. 2) of the antenna devices) and b) forming one or more beams (e.g., main lobe of an antenna characteristic defined by a single one or a plurality of individual antenna devices) therefrom, e.g. by influencing a phase and/or amplitude of the individual signals is2 (FIG. 2) received at the respective first antenna elements 111 or the signals is2' (FIG. 2) derived therefrom via the signal processing devices 112, and by irradiating the so modified signals by the respective second antenna elements 113 (FIG. 2). For illustration purposes, a single second antenna element of one of the 100 antenna devices of the antenna arrangement 1100 is depicted in FIG. 4 with the reference sign 113'.

According to further exemplary embodiments, the plurality of antenna devices of the antenna arrangement 1100 ("reconfigurable lens") can be considered as an array of weakly coupled (or, ideally, independent) "pixels" (in other words, "unit cells"), which allow locally manipulating (e.g., by using the signal processing device 112) the phase and/or amplitude of the incident field (as received by the first antenna element 111, FIG. 2), radiated by any element of the feeding device 120. A resulting radiation pattern of the antenna arrangement 1100 can be described as a superposition of the electromagnetic fields created by said "unit cells", i.e. the individual antenna devices or their second antenna elements 113, respectively. Thus, constructively combining the electromagnetic waves, the plurality of antenna devices of the antenna arrangement 1100 may act similarly to a lens for optical signals by focusing/directing a radiation pattern of electromagnetic waves (e.g., in the millimeter wave range), while not necessarily looking like an actual optical lens. In other words, according to further exemplary embodiments, the antenna arrangement 1100 may be realized as a flat planar multi-layer printed circuit board. However, according to further exemplary embodiments, the plurality of antenna devices may also be arranged on one or more carrier elements having and/or constituting a non-planar surface.

Figure 5:
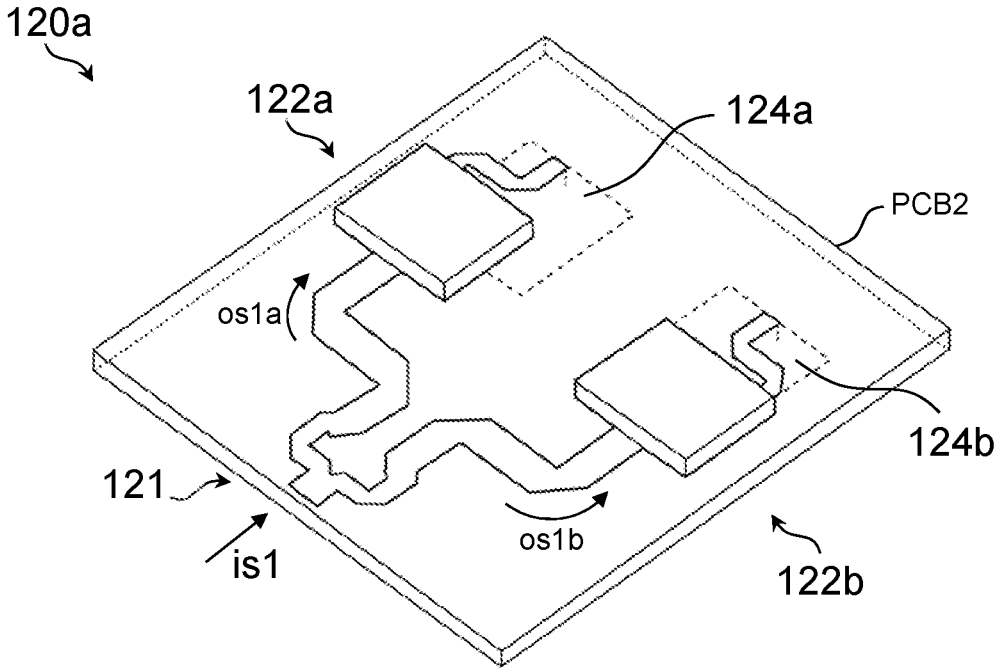

FIG. 5 schematically depicts a perspective view of a feeding device 120*a* according to further exemplary embodiments. As an example, the feeding device 120 of FIG. 1 may comprise the configuration 120*a* of FIG. 5. As depicted by FIG. 5, the feeding device 120*a* comprises an input 121 for receiving said first input signal is1 (also cf. FIG. 1). According to further exemplary embodiments, the feeding device 120*a* is configured to equally divide the first input signal is1 into n (presently n=2) many first output signals os1*a*, os1*b*, wherein each of said n many first output signals os1*a*, os1*b* comprises a 1/n-th part of the signal energy of the first input signal is1.

According to further exemplary embodiments, the feeding device 120*a* comprises at least one variable gain amplifier (VGA) 122*a*, 122*b*, which enables to control a distribution of signal power to the various replicas or copies of the first input signal, which correspond to the first output signals os1*a*, os1*b*.

According to further exemplary embodiments, the feeding device 120*a* comprises at least one patch antenna or horn antenna for providing said plurality of first output signals or signals derived from said plurality of first output signals to said plurality of antenna devices. Presently, the feeding device 120*a* comprises a first patch antenna 124*a* for irradiating the first output signal os1*a* (or a signal derived from said first output signal os1*a* by means of said first VGA 122*a*) and a second patch antenna 124*b* for irradiating the first output signal os1*b* (or a signal derived from said first output signal os1*b* by means of said second VGA 122*b*). Preferably, at least some of the components 122*a*, 122*b*, 124*a*, 124*b* (as well as signal lines connecting the various components with each other) are arranged on a common carrier element such as e.g. a printed circuit board PCB2. As an example, the input 121 and the VGAs 122*a*, 122*b* (as well as the transmission lines connecting said input 121 with the respective VGA) may be arranged on a first surface of said carrier element PCB2, while the patch antennas 124*a*, 124*b* may e.g. be arranged on a second surface of said carrier element PCB2, which is opposite to said first surface. As a further example, the feeding device 120*a* of FIG. 5 may be arranged relative to an antenna arrangement 1100 (FIG. 4) such that the patch antennas 124*a*, 124*b* of the feeding device 120*a* face the first antenna elements 111 (FIG. 2) of the antenna devices of said antenna arrangement 1100, also cf. the dashed rectangle 120 of FIG. 2.

Figure 6:
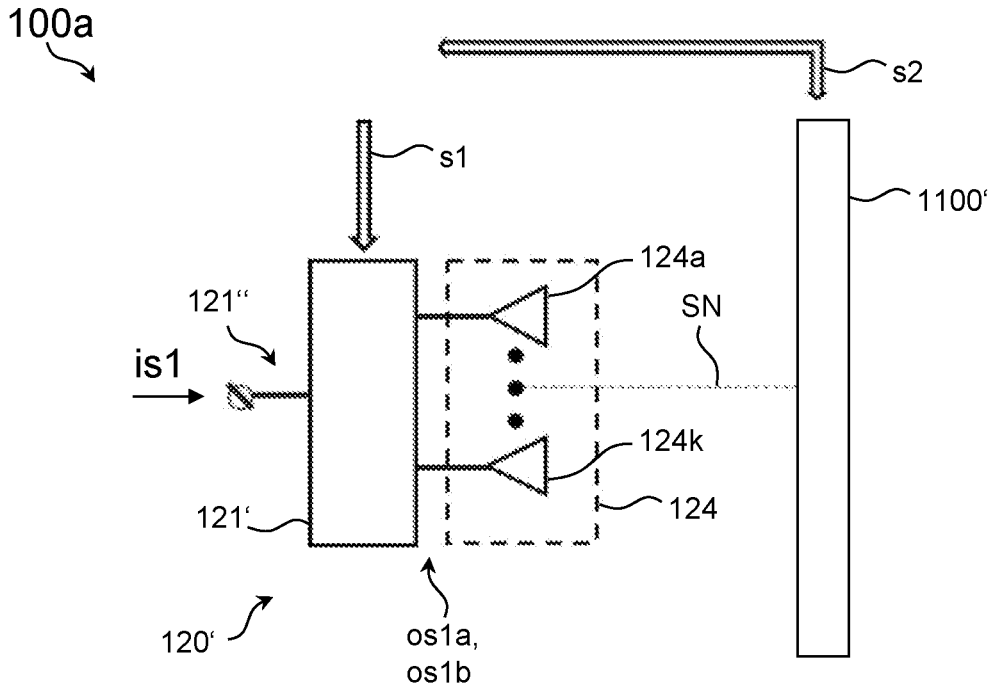

FIG. 6 schematically depicts a simplified block diagram of an apparatus 100*a* according to further exemplary embodiments. Block 121' represents a power divider with an input 121" for receiving the first input signal is1, and block 124 represents a feeding array comprising a plurality of feeding antennas 124*a*, . . . , 124*k*, e.g. patch antennas, similar to the patch antennas 124*a*, 124*b* of the feeding device 120*a* depicted by FIG. 5. The blocks 121', 124 of FIG. 6, collectively denoted by reference sign 120', comprise the functionality of the feeding device 120, 120*a* explained above, i.e. providing an antenna arrangement 1100' (which may e.g. comprise the configuration 1100 of FIG. 4) with a plurality of (e.g., up to k many) first output signals os1*a*, os1*b*, only two of which are depicted by FIG. 6 for reasons of clarity.

According to further exemplary embodiments, said antenna arrangement 1100' comprises a planar configuration (planar "lens") a surface normal SN of which may be aligned with a reference axis (not shown) of the feeding array 124. E.g., the surface normal SN may be parallel with the reference axis of the feeding array 124. According to further exemplary embodiments, said feeding array 124 is arranged in a focal plane of the antenna arrangement 1100' ("lens").

Arrow s1 of FIG. 6 exemplarily depicts one or more control signals for controlling an operation of the power divider 121' (e.g., one or more (optional) VGAs, that may be provided within the power divider 121', cf. FIG. 5). The control signals s1 may e.g. be provided by a control device not depicted in FIG. 6. Arrow s2 of FIG. 6 exemplarily depicts one or more control signals for controlling an operation of the antenna arrangement 1100', e.g. individual signal processing devices 112 (FIG. 2) of individual antenna devices 110, which e.g. enables to influence beam(s) as generated by the antenna arrangement 1100' (preferably regarding the number of beams and/or a shape of one or more beams and/or an angular orientation of one or more of said beams).

According to further exemplary embodiments, said apparatus 100, 100*a* exemplarily disclosed above with respect to FIGS. 1 to 6 is configured to receive a first input signal is1, e.g. in the millimeter wave range, and to transmit it via the second antenna elements 113 (FIG. 2) of its plurality of antenna devices 110, e.g. in the form of one or more antenna beams. As an example, the apparatus 100, 100*a* may be configured to generate one or more "pencil beams" having e.g. a gain of about 20 dBi (20 decibel with respect to an ideal isotropic antenna). According to further exemplary embodiments, said first input signal is1 may be provided to the apparatus 100, 100*a* or its feeding device 120, respectively, by means of an RF (radio frequency) waveguide, e.g. cable or hollow waveguide or the like.

According to further exemplary embodiments, said apparatus 100 is also configured to receive, via said plurality of antenna devices 110 (FIG. 1), e.g. arranged in form of an antenna arrangement 1100 as exemplarily depicted by FIG. 4, electromagnetic waves, i.e. in addition to its capability to transmit electromagnetic waves in the form of multiple beams depending on said first input signal. As an example, by controlling the signal processing devices 112 of individual antenna devices 110, similar "receive beams", e.g. a resulting antenna characteristic for the receive case may be attained as described above with respect to the transmit case. Preferably, according to further exemplary embodiments, the signal processing devices 112 of individual antenna devices 110 can both work in a transmit direction (cf. e.g. FIG. 2) as well as in a receive direction. Alternatively, according to further exemplary embodiments, different signal processing devices (not shown) may be provided in at least some antenna devices (e.g., a first signal processing device 112 for the transmit case, and a second signal processing device (not shown) for the receive case).

According to further exemplary embodiments, said apparatus 100, 100*a* is configured to receive and/or transmit electromagnetic waves in the millimeter range. As an example, the apparatus 100, 100*a* may be configured to transmit and/or receive and/or process (cf. e.g. the signal processing devices 112 of the individual antenna devices 110, FIG. 2) electromagnetic waves and corresponding electric signals at e.g. 28 GHz. According to further exemplary embodiments, said apparatus is configured to receive and/or transmit electromagnetic waves (and/or to process corresponding electric signals) in frequency ranges as usable e.g. for 5G (fifth generation) communications systems, e.g. in frequency bands at about 28 GHz and/or 39 GHz and/or 60 GHz, and/or for IEEE 802.11ad standards ("Wireless Gigabit" or "Wigig").

Figure 8:
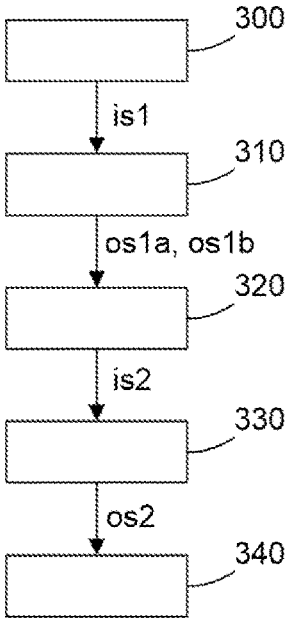

Further exemplary embodiments, cf. the flow-chart of FIG. 8, relate to a method of operating an apparatus 100, 100*a* comprising a plurality of antenna devices 110 (FIG. 1) and a feeding device 120, wherein said feeding device 120 receives 300 (FIG. 8) a first input signal is1, generates 310 a plurality of first output signals by power dividing said first input signal is1, and provides 320 said plurality of first output signals to said plurality of antenna devices 110, wherein two or more of said antenna devices 110 (each) comprise a first antenna element 111 (FIG. 2) for receiving at least a portion of said plurality of first output signals as a second input signal is2, a signal processing device 112 configured to determine 330 a second output signal os2 depending on said second input signal is2 by at least temporarily modifying a phase and/or an amplitude of said second input signal is2 or a signal is2' derived from said second input signal is2, and a second antenna element 113, wherein said signal processing device 112 provides 340 (FIG. 8) said second output signal os2 to said second antenna element 113, e.g. for irradiation in form of one or more antenna beams to one or more receivers (not shown).

Figure 7:
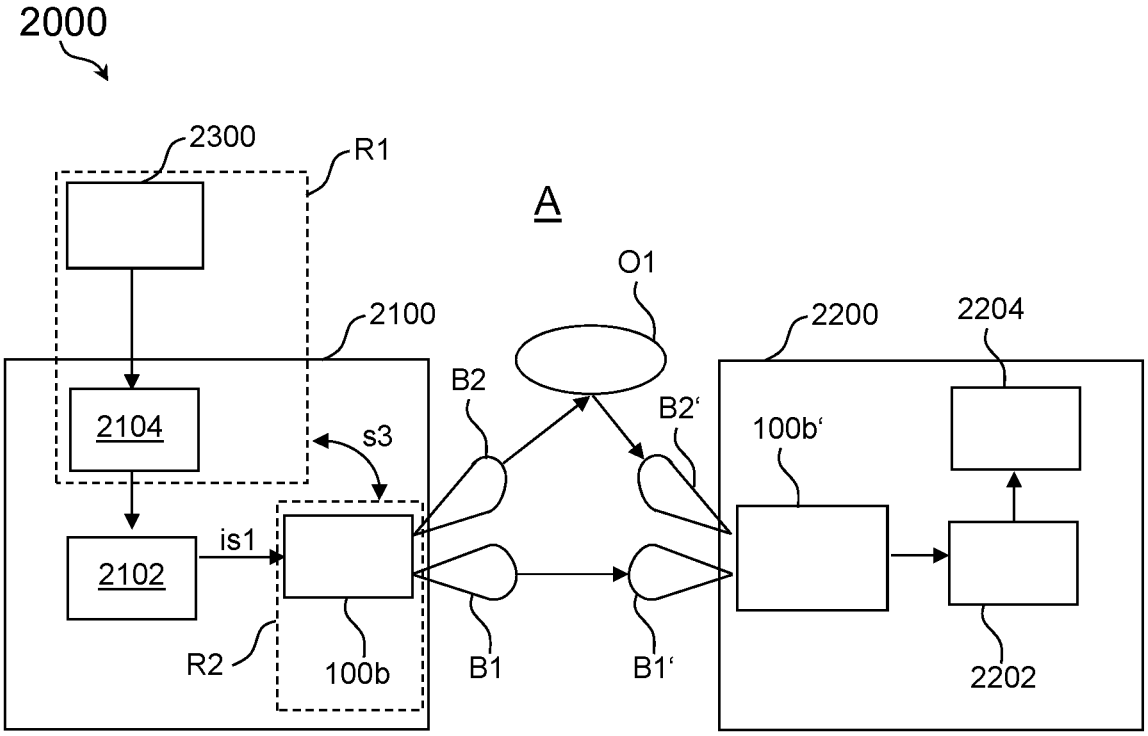

FIG. 7 schematically depicts a simplified block diagram of a system 2000 according to further exemplary embodiments. The system 2000 comprises a first device 2100, which may e.g. represent a base station or an access point ("AP") for wireless communications, and a second device 2200, which may e.g. represent a user equipment ("station"). According to further exemplary embodiments, the first device 2100 may comprise an apparatus 100*b* according to the embodiments, wherein the apparatus 100*b* may e.g. comprise the configuration 100, 100*a* as explained above and may be configured to transmit data corresponding to a first input signal is1 by means of electromagnetic waves e.g. in the millimeter range, especially in the form of one or more, preferably comparatively narrow beams (e.g., "pencil beams") B1, B2.

According to further exemplary embodiments, the second device 2200 may comprise an apparatus 100*b'*, which may be a conventional receiver configured to receive data transmissions from the apparatus 100*b* of the first device 2100 or which may, alternatively, be an apparatus according to the embodiments, e.g. similar to the apparatus 100, 100*a*, 100*b*, wherein the apparatus 100*b'* is also configured to receive said data transmissions from the apparatus 100*b* of the first device 2100. According to further exemplary embodiments, the apparatus 100*b'* may comprise an antenna arrangement 1100 (FIG. 4), and by controlling its antenna arrangement 1100, the apparatus 100*b'* may define one or more antenna beams B1', B2' for signal reception. This way, one or more transmit-receive beam pairs B1, B1', B2, B2' may be provided for data transmission between the devices 2100, 2200 according to further exemplary embodiments.

According to further exemplary embodiments, the first device 2100 may comprise a transceiver 2102 configured to provide said first input signal is1 to the apparatus 100*b*, and/or a buffer 2104 for buffering data to be sent via the first device 2100 or its apparatus 100*b*. According to further exemplary embodiments, an application server 2300 may be provided which may be configured to provide said data to be sent via the first device 2100 or its apparatus 100*b* to the first device 2100, particularly to its buffer 2104 and/or the transceiver 2102. The optional data connection s3 may be provided according to further exemplary embodiments, enabling to provide techniques of coordination and/or feedback and/or exchange related to the apparatus 100*b* and the components 2300, 2104, such as e.g. a rate and/or latency control, cf. the dashed rectangle R1, and/or a power and/or reliability control, cf. the dashed rectangle R2. Further aspects of such embodiments are explained further below.

Similarly, according to further exemplary embodiments, the second device 2200 may comprise a transceiver 2202 configured to receive a signal received by the apparatus 100*b'*, and/or an application client 2204 that may process so received signals.

As explained above, while the present exemplary explanations primarily relate to a transmit operation of said apparatus 100*b* of the first device 2100, i.e. for transmitting data from said first device 2100 to the second device, and to a receive operation of the apparatus 100*b'* of the second device 2200, according to further exemplary embodiments, it is also possible for the apparatus 100*b'* of the second device 2200 to perform a transmit operation similar to the one explained with respect to the apparatus 100*b* of the first device 2100, wherein the apparatus 100*b* of the first device 2100 may be configured to perform a corresponding receive operation.

Figure 9:
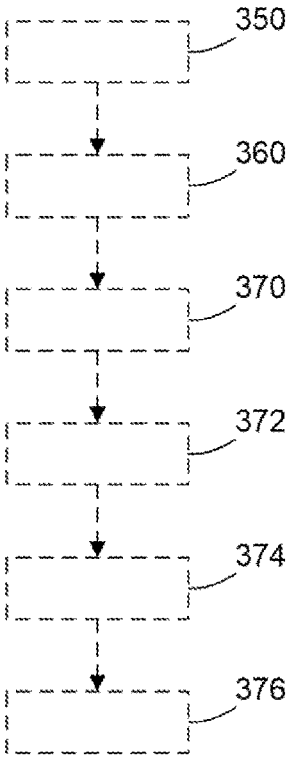

According to further exemplary embodiments of the method explained above with respect to FIG. 8, said method further comprises, cf. FIG. 9, deploying 350 one or more scattering objects O1 (FIG. 7), particularly objects having a metallic or metallized surface, in a transmission area A surrounding the apparatus 100*b* according to the embodiments and/or its antenna devices. This enables to increase signal transmission quality by also exploiting potential non-line-of-sight (NLOS-) paths, because the signal(s) transmitted by means of the apparatus 100, 100*a*, 100*b*, e.g. in the form of one or more beams B1, B2, may at least partly be scattered by said one or more scattering objects O1 thus enabling to overcome obstacles or environmental conditions (e.g., topology) that may block or prevent line-of-sight (LOS) transmission paths.

According to further exemplary embodiments, cf. FIG. 9, said method further comprises generating 360 at least two beams B1, B2 (FIG. 7) by means of said plurality of antenna devices 110 (FIG. 1) of the apparatus 100*b* for transmitting information comprised within said first input signal is1 via said at least two beams B1, B2, e.g. to the second device 2200.

According to further exemplary embodiments, cf. FIG. 9, said method further comprises at least one of the following elements: a) determining 370, preferably periodically, a quality measure associated with at least one transmit-receive-beam pair B1, B1', B2, B2' (FIG. 7), e.g. a signal-to-noise ratio (SNR) associated with said at least one transmit-receive-beam pair, b) identifying 372 N many (presently two in FIG. 7) transmit-receive beam pairs and dividing a signal power of said first input signal is1 (FIG. 7) to said N many transmit-receive beam pairs (e.g., by controlling the feeding device 120 of apparatus 100*b*), particularly such that one or more predetermined criteria for a signal transmission using said apparatus 100*b* can be met. According to further exemplary embodiments, such predetermined criteria may comprise: a target data rate (e.g., to be able to deliver all data of the buffer 2104 (FIG. 7) to be transmitted in a single transport block), one or more beams B1, B2 satisfying a (e.g. PHY (physical layer-related)) reliability constraint (e.g., expressed as a minimal sector width or maximal number of beam pairs supporting a target data rate).

Figure 10:
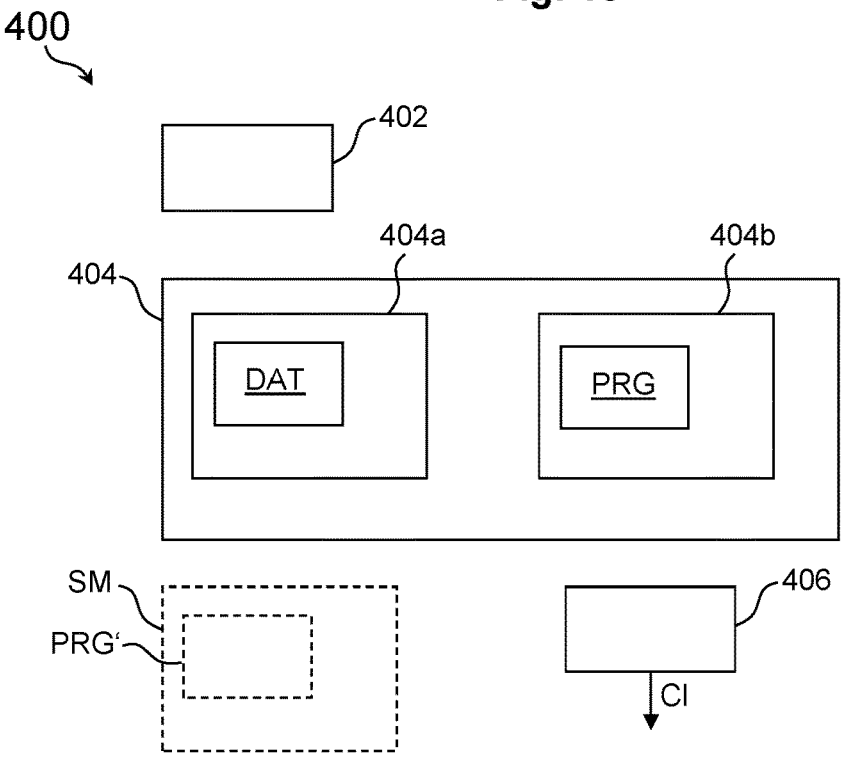

In the following, further exemplary embodiments are provided, wherein FIG. 10 schematically depicts a simplified block diagram of a control unit 400 that may be configured to perform the method according to the embodiments.

The control unit 400 comprises at least one calculating unit 402 and at least one memory unit 404 associated with (i.e., usably by) said at least one calculating unit 402 for at least temporarily storing a computer program PRG and/or data DAT, wherein said computer program PRG is e.g. configured to at least temporarily control an operation of said control unit 400, e.g. the execution of a method according to the embodiments, for example for controlling an operation of the apparatus 100 (FIG. 1) and/or of at least one of its components 110, 120.

According to further exemplary embodiments, said at least one calculating unit 402 (FIG. 10) comprises at least one of the following elements: a microprocessor, a microcontroller, a digital signal processor (DSP), a programmable logic element (e.g., FPGA, field programmable gate array), an ASIC (application specific integrated circuit), hardware circuitry. According to further exemplary embodiments, any combination of two or more of these elements is also possible.

According to further exemplary embodiments, the memory unit 404 comprises at least one of the following elements: a volatile memory 404*a*, particularly a random-access memory (RAM), a non-volatile memory 404*b*, particularly a Flash-EEPROM. Preferably, said computer program PRG is at least temporarily stored in said non-volatile memory 404*b*. Data DAT, which may e.g. be used for executing the method according to the embodiments, may at least temporarily be stored in said RAM 404*a*.

According to further exemplary embodiments, an optional computer-readable storage medium SM comprising instructions, e.g. in the form of a further computer program PRG', may be provided, wherein said further computer program PRG', when executed by a computer, i.e. by the calculating unit 402, may cause the computer 402 to carry out the method according to the embodiments. As an example, said storage medium SM may comprise or represent a digital storage medium such as a semiconductor memory device (e.g., solid state drive, SSD) and/or a magnetic storage medium such as a disk or hard disk drive (HDD) and/or an optical storage medium such as a compact disc (CD) or DVD (digital versatile disc) or the like.

According to further exemplary embodiments, the control unit 400 may comprise an optional control interface 406, preferably for bidirectional data exchange with an external device such as e.g. the apparatus 100, 100*a*, 100*b*, 100*b*' and/or one of its components 110, 120. As an example, by means of said control interface 406, the apparatus 400 may at least temporarily control an operation of the apparatus 100, 100*a*, 100*b*, 100*b*' and/or one of its components 110, 112, 120, 122*a*, 122*b* cf. the arrow CI symbolizing respective control information.

According to further exemplary embodiments, using said control interface 406, the apparatus 400 may control the feeding device 120 (FIG. 1), 120*a* (FIG. 5), e.g. by controlling at least one of said VGAs 122*a*, 124*a*. According to further exemplary embodiments, using said control interface 406, the apparatus 400 may control the operation of one or more of said antenna devices 110 and/or of their respective signal processing device 112 (cf. the control input 112' of FIG. 2). This way, for example, a number and/or spatial orientation of beams B1, B2 (FIG. 7) of electromagnetic radiation as may be provided by means of said apparatus 100, 100*a*, 100*b* may be influenced.

According to further exemplary embodiments, by employing the apparatus 100, 100*a*, 100*b*, a native physical layer reliability of wireless transmissions (e.g., between devices 2100, 2200, FIG. 7) may be improved, because a signal to be transmitted may be delivered from a single transceiver 2102 over multiple parallel propagation paths B1, B1', B2, B2' by using the apparatus 100*b* and by power splitting as explained above with respect to the feeding device 120. According to further exemplary embodiments, the apparatus 100*b* may also be denoted as a multi-beam antenna system.

According to further exemplary embodiments, an end-to-end latency and data rate control may be coordinated, e.g. based on closed-loop feedback (transport-layer measures).

According to further exemplary embodiments, regarding the feeding device 120, 120*a* (FIG. 1, 5), several feeding elements 124*a*, 124*b* (FIG. 5) may be used to provide multiple parallel propagation paths, wherein said several feeding elements 124*a*, 124*b* may be connected using a power-dividing circuit (PDC, also cf. block 121' of FIG. 6), which according to further exemplary embodiments can provide an arbitrary power ratio between them. According to further exemplary embodiments, a number of feeding elements 124*a*, 124*b* may be equal to a number of potentially created beams B1, B2 (FIG. 7), i.e. number of utilizable propagation paths.

According to further exemplary embodiments, for at least one radio link between the first device 2100 and the second device 2200 of the system 2200, one or more of the following steps may be performed:

a) measure (preferably periodically) the SNR of all TX(transmit)-RX(receive) beam pairs (BP), e.g. B1, B1', B2, B2', b) identify N many BPs, N>1, and an N-fold partition of total transceiver power (e.g., 1/N fraction of total power per signal replica) among those BPs such that each BP can support a data rate target rate (e.g., to deliver all data in the send buffer 2104 in a single transport block), and/or that all beams B1, B2 satisfy a PHY reliability constraint (e.g., expressed as minimal sector width or maximal N of BPs supporting target rate), c) deliver data from the first device 2100 to the second device 2200 on a so established link.

According to further exemplary embodiments, a latency control algorithm may be applied, also cf. the optional step 374 of FIG. 9. As an example, according to further exemplary embodiments, for each link between an access point 2100 (FIG. 7) and an associated station 2200, increase (decrease) a target data rate/decrease (increase) a reliability target if a queuing delay in the send buffer 2104 exceeds (drops below) maximum permissible level (e.g., until queue is flushed (restored)).

In other words, according to further exemplary embodiments, the following steps may be performed: determining a queuing delay in the buffer 2104, and, depending on said queuing delay, preferably for each link between the access point 2100 and the associated station 2200, increasing (decreasing) the target data rate/decreasing (increasing) the reliability target. As an example, the aforementioned steps may be performed by the control unit 400 (FIG. 10).

According to further exemplary embodiments, a rate adaptation algorithm may be applied, also cf. the optional step 376 of FIG. 9. As an example, for at least one radio link between the first device 2100 (FIG. 7) and the second device 2200 of the system 2200, one or more of the following steps may be performed: reporting directly or inferring indirectly at least one performance indicator (e.g., SNR of a beam pair B1, B1', transmission aggregation level, reliability level, send buffer queuing delay of e.g. buffer 2104), adapting at least one property of said at least one radio link depending on said at least one performance indicator, e.g. by means of quality-of-service (QoS) adaptation (e.g. modifying at least one of: congestion window/multi-path scheduling policies at an application server 2300, network slicing controller, QoS controller).

According to further exemplary embodiments, the AP 2100 (FIG. 7) performs the following steps: periodically measure the SNR of at least one beam pair (BP) B1, B1', B2, B2', preferably of all BPs, and identify the BP with the highest SNR among all BPs ("primary beam") and/or the BP with the highest SNR that is at least a minimal angular distance from the highest-SNR beam ("secondary beam"). Alternatively, all beams that meet minimum SNR requirement are selected.

According to further exemplary embodiments, the transmission data rate is set to match a performance of the secondary beam pair with lower SNR by controlling wireless parameters such as coding/modulation scheme and/or aggregation level. According to further exemplary embodiments, a BP selection and/or power splitting process can be subjected to additional interference-control/hardware/regulatory constraints.

According to further exemplary embodiments, the AP 2100 may also maintain the end-to-end latency within a pre-defined range to compensate for undesirable latency spikes, e.g. in the event of (1) imperfect estimation of link bandwidth-delay product (elastic apps with rate adaptation), (2) constant frame-rate video and fixed compression (inelastic apps without rate adaptation), (3) arrival of data bursts associated with multiple (uncoordinated) application flows (elastic/inelastic).

According to further exemplary embodiments, the AP may increase (or decrease) its serving data rate until excess data in send buffer is flushed (or conversely built up to required level).

According to further exemplary embodiments, at least one of the following control approaches may be implemented for an operation of the system 2000 (FIG. 7).

Control approach 1 ("AP as master node"): An autonomous AP 2100 maximizes its transmission reliability for each destination MAC (media access control (address)) (IP (Internet Protocol (address)) based on self-chosen constraints (e.g., max. queuing delay), or as communicated by the application or QoS policy server 2300. The station 2200 reports aggregation levels to the server (e.g., 1 TCP ACK (acknowledgement) for each data block aggregated by the AP 2100 during wireless transmission) to indicate queuing delay. The server uses this feedback for rate/congestion control but may otherwise be unaware of reliability protection mechanisms, i.e. may not be aware of beam pair SNRs and reliability constraints.

Control approach 2 ("Application server as master node"): The AP 2100 informs the server 2300 about a current reliability level and/or BP SNRs and/or overall latency and/or queuing conditions (e.g., of buffer 2104) (i.e., instead of aggregation level as in previous case). The server 2300 may then actively adapt its rate/congestion control and/or multi-path scheduling logic with the purpose to either coordinate with the AP 2100 reliability protection actions, or to control the AP actions directly.

According to Applicant's analysis, according to further exemplary embodiments, very high levels of additional physical-layer reliability can be achieved by activating even beams B1, B2 (FIG. 7) with comparatively low SNRs that may typically offer data rates "only" at a level of several hundreds of Mbps, i.e., an order-of-magnitude "slower" than the dominant connection components, which may typically reach even multi-Gbps data rates.

The reason is that, according to further exemplary embodiments, real network nodes may be unable to consume such peak rates, not even remotely, due to the following facts:

- device software limitations—experiments show that devices like tablets and phones may not be able to physically process higher data rates than 300-500 Mbps due to the physical limits of device hardware and operating system (e.g., memory access time, bus speeds and multiplexing interrupts, CPU/GPU speed, complexity of network socket protocol stack).
- application limitations—user applications may be unable to consume high data rates (typically less than 350 Mbps for plain FTP (file transfer protocol) data transfer requiring no additional processing in addition to basic memory access) as this would require sophisticated optimization for particular platforms (e.g., shared memory space for kernel and application, polling/interrupt optimization, etc.). Moreover, interactive applications may generate content data in periodical bursts (e.g., defined by a video frame rate), which limits the data rate requirements,
- transport protocols—legacy protocols such as TCP (transmission control protocol) require extremely low bit-error rate (<10^−9) and large buffer memory (100s of Mb) as well as very low round trip time (<10 ms) to maintain Gbps connections which may be practically difficult to achieve,
- backhaul sharing and network densification—radio access points may share the same backhaul network and so the maximum per-use rate may be limited by the number of the active network users and their traffic volume (e.g., 1 Gbps Ethernet/100 CCTV cameras=10 Mbps on average per camera). Moreover, high-performance networks may require dense access point deployment which may reduce the number of server users per access points and thus the demand on peak rate.

Altogether, exemplary embodiments enable to provide ultra-reliable low-latency communications, URLLC, which may be used for industrial automation applications (e.g., Industry 4.0 projects), mobile and edge-cloud computing (e.g., for interactive VR/AR applications), and many other fields of application. According to further exemplary embodiments, backward compatibility with conventional receiver hardware may be maintained, e.g. when using the apparatus 100*b* (FIG. 7) on a transmitter side.

The invention claimed is:

1. An apparatus comprising a plurality of antenna devices, a plurality of signal processing devices, and a feeding device, wherein said feeding device is configured to receive a first input signal (is1), to generate a plurality of first output signals (os1*a*, os1*b*) by power dividing said first input signal (is1), and to provide said plurality of first output signals (os1*a*, os1*b*) to said plurality of antenna devices, wherein said plurality of antenna devices comprise:

a plurality of first patch antenna elements on a first surface of a first printed circuit board (PCB), each first patch antenna element for receiving at least a portion of said plurality of first output signals (os1*a*, os1*b*) as a second input signal (is2), and a plurality of second patch antenna elements on a second surface of the first PCB opposite the first surface, each second patch antenna element being opposite to a respective first patch antenna element, wherein:

each signal processing device is in a layer of the first PCB between a corresponding first patch antenna element and the respective second patch antenna element, each signal processing device is configured to determine a second output signal (os2) depending on said second input signal (is2) by at least temporarily modifying a phase or an amplitude of said second input signal (is2) or a signal (is2') derived from said second input signal (is2), each signal processing device is configured to provide said second output signal (os2) to said respective second patch antenna element, and each signal processing device is individually controllable to locally manipulate at least one of phase and amplitude of an incident electromagnetic field.

2. The apparatus according claim 1, wherein the first patch antenna elements are arranged in a matrix-type pattern comprising a first number of rows and a second number of columns.

3. The apparatus according to claim 1, wherein the feeding device is configured to equally divide the first input signal (is1) into n many first output signals (os1*a*, os1*b*), wherein each of said n many first output signals (os1*a*, os1*b*) comprises a 1/n-th part of the signal energy of the first input signal (is1).

4. The apparatus according to claim 1, wherein the feeding device comprises at least one variable gain amplifier and at least one patch antenna for providing at least one of said plurality of first output signals (os1*a*, os1*b*) and signals derived from said plurality of first output signals (os1*a*, os1*b*) to said plurality of antenna devices.

5. The apparatus according to claim 1, wherein said apparatus is configured to receive and transmit electromagnetic waves in the millimeter range.

6. The apparatus of claim 1, wherein each signal processing device is electrically connected to the corresponding first patch antenna element and further electrically connected to the respective second patch antenna element, the electrical connections being through vias in the layer.

7. The apparatus of claim 1, wherein the plurality of first patch antenna elements includes 16 or more individual first patch antenna elements.

8. The apparatus of claim 7, wherein the plurality of first patch-antenna elements includes at least 80 individual first patch antenna elements.

9. The apparatus of claim 1, wherein the first patch antenna elements are arranged in a matrix-type pattern comprising a first number of rows and a second number of columns, each of the first and second numbers being greater than five.

10. The apparatus of claim 1, wherein the feeding device is configured to provide the incident electromagnetic field.

11. The apparatus of claim 10, wherein the feeding device comprises:

a splitter to power-split an input signal; and a plurality of third patch antenna elements connected to the splitter to receive power portions of the input signal to irradiate the plurality of first patch antenna elements.

12. The apparatus of claim 11, wherein the feeding device further comprises a second PCB; and wherein the third patch antenna elements are on a surface of the second PCB.

13. The apparatus of claim 11, wherein the feeding device further comprises a plurality of variable gain amplifiers, each of the variable gain amplifiers being connected between a respective output of the splitter and a respective one of the third patch antenna elements.

14. A method of operating an apparatus comprising a plurality of antenna devices, a plurality of signal processing devices, and a feeding device, wherein said feeding device receives a first input signal (is1), generates a plurality of first output signals (os1*a*, os1*b*) by power dividing said first input signal (is1), and provides said plurality of first output signals (os1*a*, os1*b*) to said plurality of antenna devices, wherein said plurality of antenna devices comprise:

a plurality of first patch antenna elements on a first surface of a first PCB, each first patch antenna element for receiving at least a portion of said plurality of first output signals (os1*a*, os1*b*) as a second input signal (is2), and a plurality of second patch antenna elements on a second surface of the first PCB opposite the first surface, each second patch antenna element being opposite to a respective first patch antenna element, wherein:

each signal processing device is in a layer of the first PCB between a corresponding first patch antenna element and the respective second patch antenna element, each signal processing device determines a second output signal (os2) depending on said second input signal (is2) by at least temporarily modifying a phase or an amplitude of said second input signal (is2) or a signal (is2') derived from said second input signal (is2), each signal processing device provides said second output signal (os2) to said second patch antenna element, and each signal processing device is individually controllable to locally manipulate at least one of phase and amplitude of an incident electromagnetic field.

15. The method according to claim 14, further comprising deploying scattering objects (O1) in a transmission area (A) surrounding the apparatus and its antenna devices.

16. The method according to claim 14, further comprising: generating at least two beams (B1, B2) by means of said plurality of antenna devices for transmitting information comprised within said first input signal (is1) via said at least two beams (B1, B2).

17. The method according to claim 14, further comprising at least one of the following elements: a) determining a quality measure associated with at least one transmit-receive-beam pair (B1, B1'; B2, B2'), and b) identifying N many transmit-receive beam pairs and dividing a signal power of said first input signal (si1) to said N many transmit-receive beam pairs, such that one or more predetermined criteria for a signal transmission using said apparatus can be met.

18. The method according to claim 14, further comprising applying a rate adaptation algorithm and a latency control algorithm.

* * * * *